US006574824B2

(12) United States Patent
Burns et al.

(10) Patent No.: US 6,574,824 B2
(45) **Date of Patent: *Jun. 10, 2003**

(54) PAINT ROLLER THUMB LOCKING MEANS

(75) Inventors: Harlow H. Burns, Omaha, NE (US); Van H. Burns, Omaha, NE (US); Brian D. Burns, 7107 S. 145th, Omaha, NE (US) 68138

(73) Assignee: Brian D. Burns, New Symrna Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/802,010

(22) Filed: Mar. 9, 2001

(65) Prior Publication Data

US 2001/0049852 A1 Dec. 13, 2001

Related U.S. Application Data

(60) Provisional application No. 60/189,272, filed on Mar. 14, 2000.

(51) Int. Cl.[7] ..... B05C 17/02
(52) U.S. Cl. ..... 15/230.11; 15/248.2
(58) Field of Search ..... 15/230.11, 248.2

(56) References Cited

U.S. PATENT DOCUMENTS 3,623,180 A * 11/1971 Anderson
4,196,491 A 4/1980 Baril
5,623,740 A 4/1997 Burns et al.

* cited by examiner

*Primary Examiner*—Randall E. Chin
(74) *Attorney, Agent, or Firm*—James D. Welch

(57) ABSTRACT

A shielded paint roller for use in paint edging work, having paint roller sock filling and painting orientation control capability and including a thumb operated lock to maintain the roller sock in a painting position while paint is being applied.

8 Claims, 4 Drawing Sheets

PAINT ROLLER THUMB LOCKING MEANS

This Application is a U.S. Provisional Patent Application Ser. No. 60/189,272 filed, Mar. 14, 2000.

TECHNICAL FIELD

The present invention relates to paint application means, and more particularly to a paint roller apparatus comprising a generally cylindrical roller sock, edge guard means and means for securing relative orientation therebetween, as well as methodology of application in the painting of a surface which is adjacent to a surface which is protected, by said edge guard means, from being simultaneously painted.

BACKGROUND

A common problem encountered by painters is that of "edging". That is, applying paint to a surface but not to an adjacent surface. This problem presents, for instance, at corners of rooms, or where a ceiling meets walls, or where trim is present etc.

The most common approach to preventing application of paint to surfaces which are not to be painted, while applying paint to immediately adjacent surfaces is to apply masking tape and paper etc. to cover the surfaces which are not to be painted. This practice, while successful, is tedious, time consuming and even messy. It would therefore be highly desirable were apparatus and methodology available which enabled painters to "edge" without the need to apply masking tape etc.

In 1997 the Inventors of the present invention obtained a U.S. Pat. No. 5,623,740 on a Paint Roller Edge Guard system, said Patent being incorporated herein by reference. Said 740 patent described a paint roller edge guard apparatus for use with generally cylindrical roller stock, which invention has proven to be very successfully applied in practice. And, while said paint roller edge guard apparatus provided for positioning a roller sock in painting and filling positions, said 740 patent did not describe the presence of a locking means by which said roller sock could reliably be secured in the painting position, when desired by a user. In fact it has been found that in use, the system of the 740 patent at times allows the roller sock to slip from the painting position toward the filling position. While not rendering the utility of the system of the 740 patent moot, and while easily corrected when it occurs by user action, said unintended effect can be annoying. A primary purpose and/or objective of the present invention is then to provide a locking-means to a system similar to that described in the 740 patent, which locking-means can be engaged to prevent said identified untoward position change in use.

It is additionally noted that the system of the 740 patent described a spring loaded means for allowing beneficial motion of a paint roller edge guard with respect to a handle of the paint roller edge guard system described therein. The present invention, while not excluding the spring loaded means approach, provides that a preferred system utilizes non-rigid means for mounting a paint roller edge guard made of material which can be easily distorted in position/orientation by application of force thereto, but which returns to its original position/orientation when the force is removed. Preferred practice is to use the same injection molded material for fabricating a handle and the non-rigid means for mounting the paint roller edge guard.

Additional patents identified in the 740 patent were:

U.S. Pat. No. 3,369,269 to Deck;

U.S. Pat. No. 2,763,022 to Glacken; and

U.S. Pat. No. 3,623,180 to Anderson.

None of said Patents described a paint guard adapted for both pivotal and rotational movement to accommodate surface irregularities and placement during use.

Recent additional Patent Searching, with focus on the presence of "locking-means" in a paint roller apparatus, has identified a Patent to Baril, U.S. Pat. No. 4,196,491. A "locking-means" is present which facilitates securing a roller sock in positions essentially parallel and essentially perpendicular to a handle in a controllable paint roller. The purpose is to allow configuring the paint roller system for use both in a conventional position and in a position which allows use as a brush.

Even in view of the prior art, a need remains for an improved edging paint roller system, and method of its use.

DISCLOSURE OF THE INVENTION

The present invention system is a paint roller apparatus used with a generally cylindrical roller sock which, in use, is applied in painting a surface which is adjacent to a surface which is not to be simultaneously painted. Said apparatus comprises a handle having a longitudinal axis; an edge guard having a plurality of edges and front and back faces; means for affixing said edge guard to said handle such that the plane of the front face thereof faces and extends essentially parallel to the longitudinal axis of the handle, but is offset therefrom; means for rotatably affixing a roller sock to said handle such that a longitudinal axis thereof is oriented essentially perpendicular to the longitudinal axis of said handle; such that said longitudinal axis of said roller sock can be rotated about said longitudinal axis of said handle between:

- a painting position, wherein said longitudinal axis of said roller sock is oriented essentially perpendicular to and adjacent to said edge guard front face; and
- a filling position wherein the roller sock longitudinal axis is oriented other than essentially perpendicular to said edge guard front face, and typically parallel thereto.

Upon causing said roller sock to contain paint, and the placing of said roller sock in said painting position, and the positioning said back face of said edge guard adjacent to a surface which is not to be painted, said roller sock can be moved forward into contact with a surface to be painted by application of pressure to said handle, thereby causing the roller sock to contact said surface to be painted and apply paint present on said roller sock thereto, while said edge guard substantially blocks application of paint to said adjacent surface.

Said paint roller apparatus further, in the preferred embodiment, comprises a locking means on said handle which allows fixing said roller sock in the painting position, wherein the roller sock longitudinal axis is oriented essentially perpendicular to, and adjacent to said edge guard front face.

The means for rotatably affixing said roller sock to said handle, such that the longitudinal axis of said roller sock can be rotated about said longitudinal axis of said handle between a painting position and a filling position comprises, in the preferred embodiment, a shaft, a first portion of which has an axis oriented essentially parallel to said longitudinal axis of said handle and a second portion oriented perpendicularly thereto, and another, third, portion again oriented essentially parallel to said longitudinal axis of said handle and another and a forth portion being again oriented perpendicular thereto, to which forth recited portion the roller sock is affixed via roller sock support means. Said first shaft portion, with an axis oriented essentially parallel to said longitudinal axis of said handle is rotatably mounted in said handle, and said shaft further has an extension thereof oriented essentially perpendicular to said longitudinal axis of said handle which extends out of said handle, in a user accessible manner. User application of pressure to said extension can cause rotation of said shaft about said shaft longitudinal axis. This configuration is best appreciated by a viewing of FIG. 3, with reference to relevant descriptive language in the Detailed Description Section of this Specification.

The preferred embodiment provides that said locking means is slidably mounted on said handle in a manner allowing movement thereof along the direction of the longitudinal axis of said handle, and said locking means is positioned so as to allow engagement and disengagement of the extension of said shaft which is perpendicularly oriented to said longitudinal shaft axis and extends out of said handle in a user accessible manner. However, any locking means which performs the same function, by any motion, is within the scope of the present invention.

The preferred means for affixing said edge guard to said handle is non-rigid, such that application of pressure to said handle to place said roller sock in contact with a surface to be painted allows a forward edge of said edge guard, which in use contacts said surface to be painted, to move backward and become positioned even with, or behind said roller sock at said location of said roller sock contact to said surface to be painted. When said pressure is removed, said non-rigid material demonstrates "memory" and returns to its pre-stressed shape and orientation. It is noted that the 740 patent to Burns et al. demonstrated this function by applying springs mounted in the handle, and said embodiment is a non-preferred embodiment of the present invention.

Preferred construction of the present invention paint roller apparatus provides that said locking means, which allows fixing said roller sock in a painting position, be located in a position so that it is easily operated by a user's thumb when said user holds the paint roller apparatus by said handle. Additionally, preferred construction of the present invention paint roller apparatus provides that said extension, on said shaft which is oriented perpendicular to the axis oriented essentially parallel to said longitudinal axis of said handle, and which extends out of said handle, be also positioned so that it is easily operated by a user's thumb when said user holds the paint roller apparatus by said handle.

In the preferred embodiment, at least the edge of said edge guard which in use contacts said surface to be painted, comprises a bevel shape.

A method of the present invention comprises:

a. providing a present invention system is a paint roller apparatus as described above;

b. placing the roller sock into a filling position wherein the roller sock longitudinal axis is oriented other than essentially perpendicular to said edge guard front face, and typically parallel to the front surface thereof, and causing paint to be filled onto said roller sock;

c. placing the roller sock into a painting position, wherein said longitudinal axis of said roller sock is oriented essentially perpendicular to and adjacent to said edge guard front face; and d. applying pressure to said handle to force said roller sock into contact with a surface and apply paint thereto, while said edge guard substantially prevents application of paint to said adjacent surface.

The present invention will be better understood by reference to the Disclosure of the Invention Section, in conjunction with the Drawings.

SUMMARY OF THE INVENTION

A primary purpose and/or objective of the present invention is to provide a locking-means to an edge guard containing paint roller apparatus which comprises a generally cylindrical roller sock, which edge guard containing paint roller apparatus is used in painting a surface which is adjacent to a surface which is not to be simultaneously painted, which locking-means can be engaged to prevent untoward position change, between filling and painting positions, in use.

It is another purpose and/or objective of the present invention to provide a system which utilizes non-rigid means for mounting a paint roller edge guard, said non-rigid means being made of material which can be easily distorted in position/orientation by application of force thereto, but which non-rigid means returns to its original position/orientation when the force is removed.

It is another purpose and/or objective of the present invention to teach methodology for application of the present invention apparatus.

Other purposes and/or objectives of the present invention will become clear upon a reading of the Specification and claims. dr

DETAILED DESCRIPTION

Figure 1:
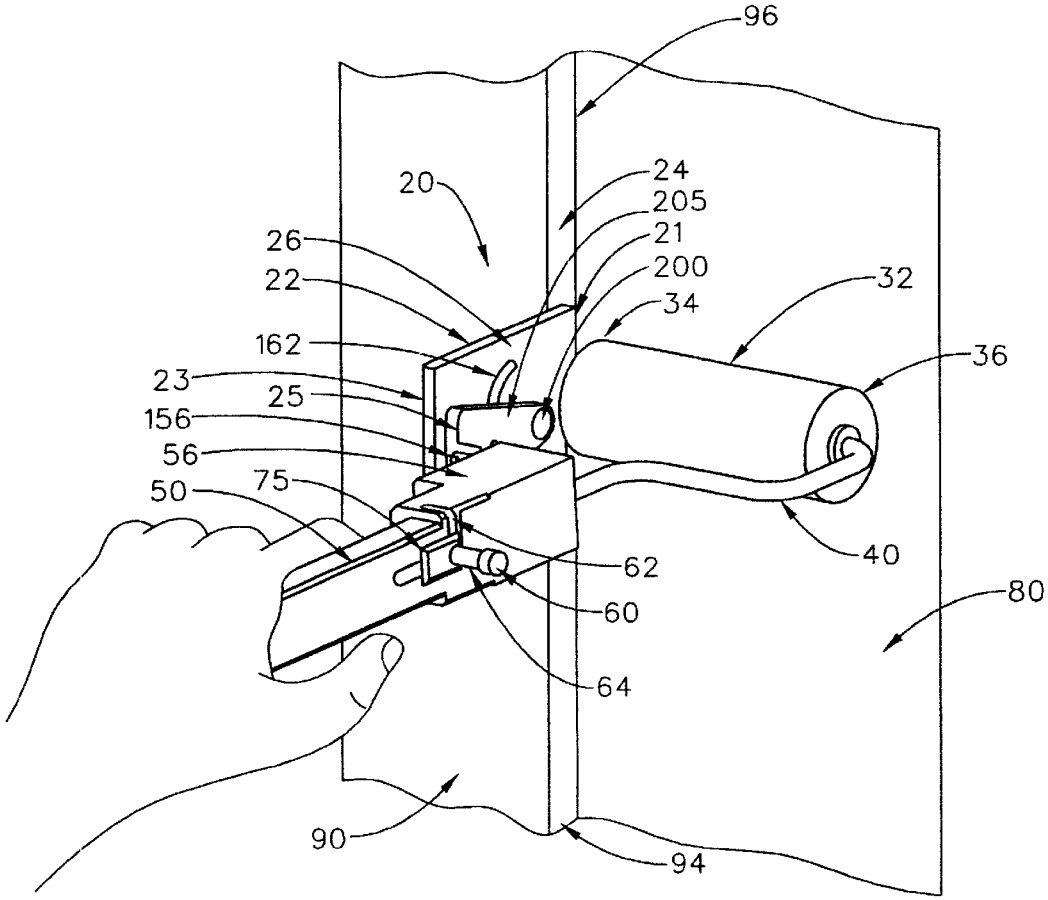
FIG. 1 shows a present invention apparatus in a painting position.
Figure 2A:
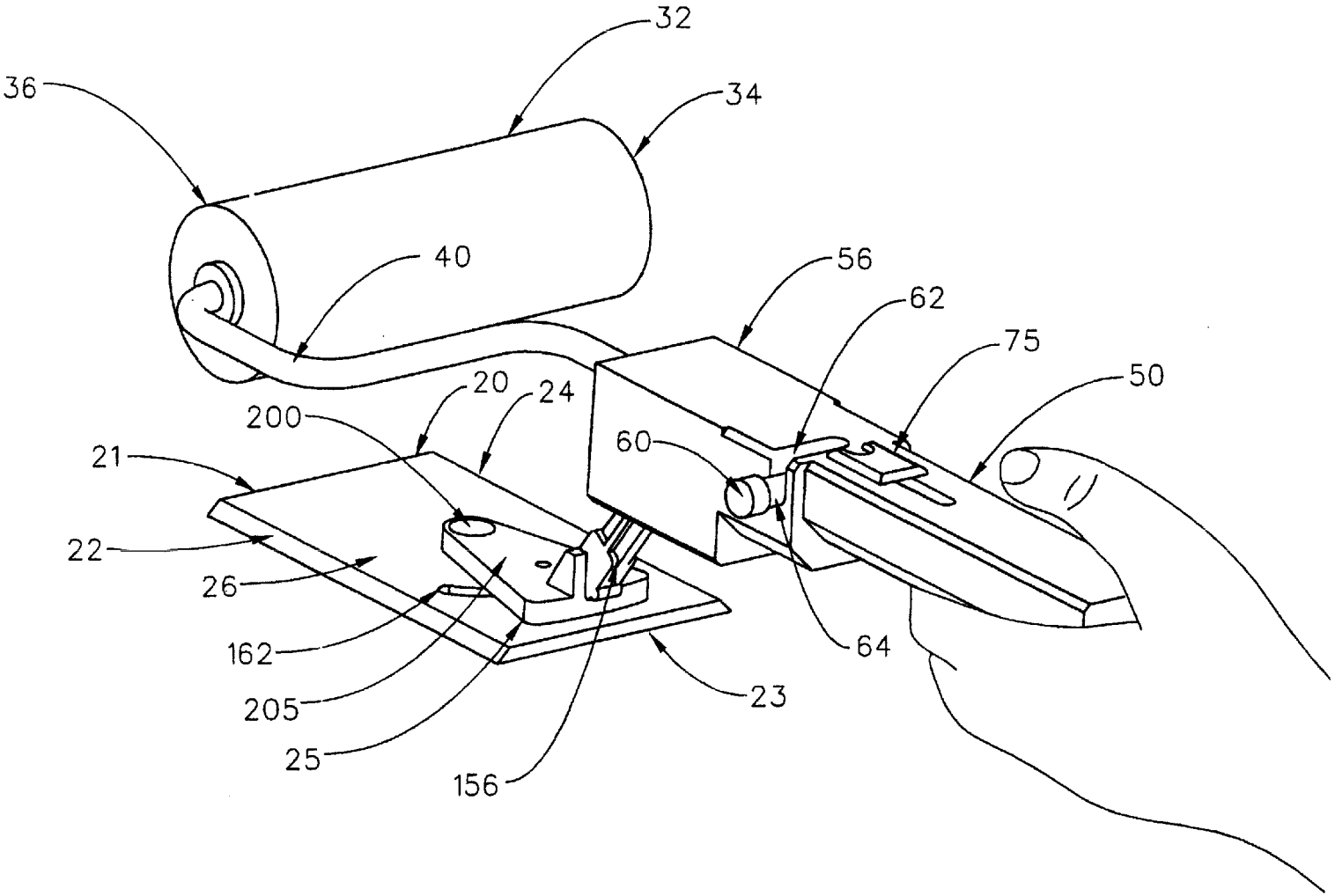
FIG 2*a* shows a present invention apparatus in a filling position.
Figure 2B:
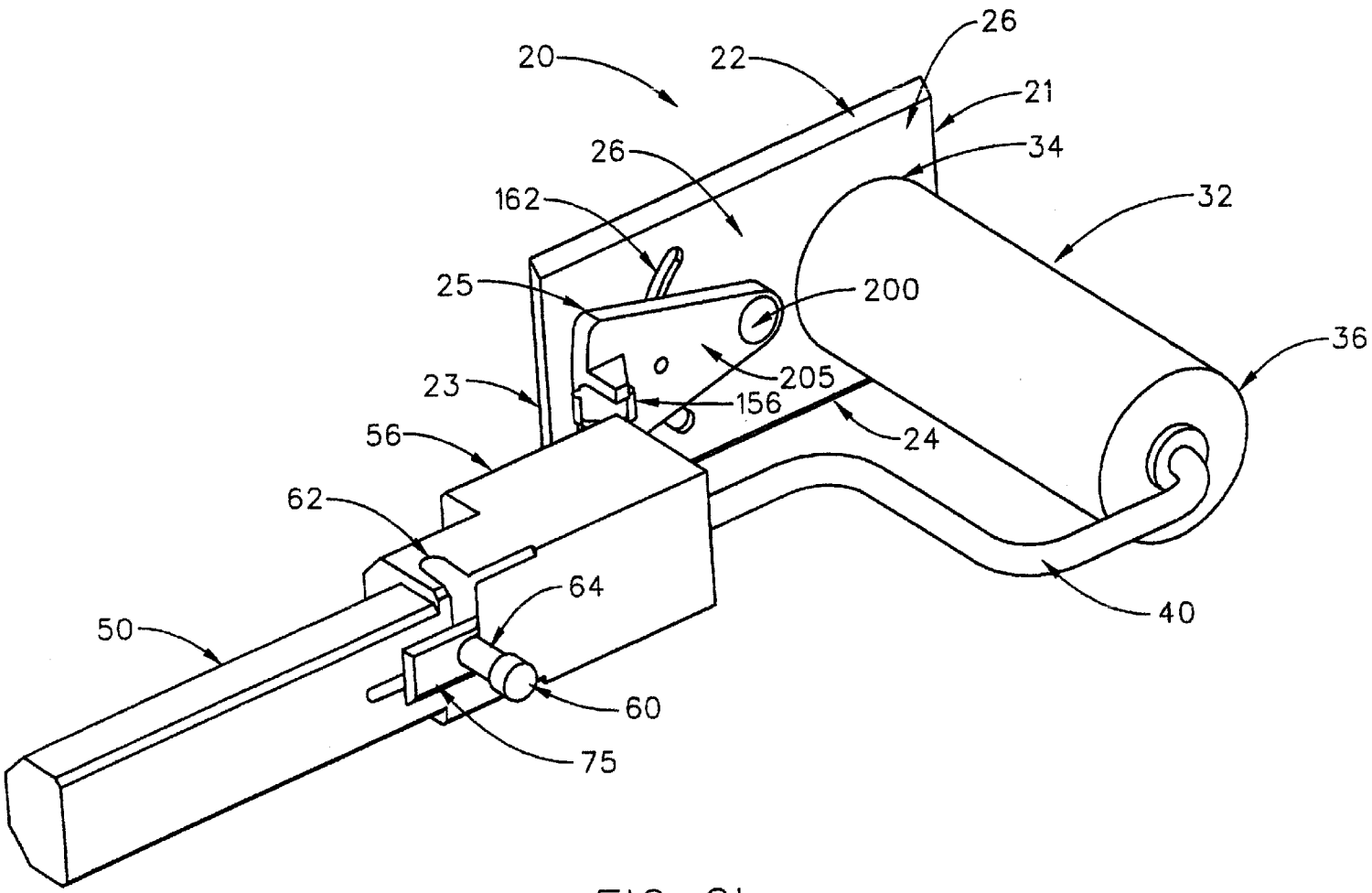
FIG. 2*b* shows a present invention apparatus in a painting position which is complementary to the view of FIG. 2*a*.
Figure 5:
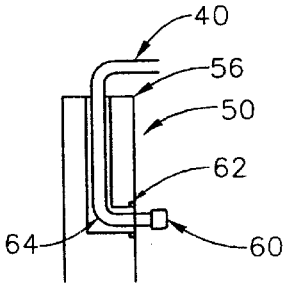
FIG. 5 shows means for rotatably affixing a roller sock to said handle.

Turning now to FIG. 1, there is shown a wall (80) with a corner (96) and another portion of the wall (90) which can be considered to be trim with edge (94). Also shown are the present invention with roller sock (32) attached via means (40) for rotatably affixing a roller sock (32) to said handle (50), through the forward portion of said handle (56). FIG. 5 shows that an extended portion of said means (40) for rotatably affixing a roller sock (32) to said handle (56) is rotatably positioned in a channel in said handle forward portion (56), and that said means (40) for rotatably affixing a roller sock to said handle (56) forward portion has a bend therein (64) which projects a longitudinal axis oriented essentially perpendicular to the longitudinal axis of said handle (56) forward portion, with an end point (60) being user accessible. FIG. 1 shows that the end point (60) of the means (40) for rotatably affixing a roller sock (32) to said handle (56) exits the handle (50) via a slot (62). Comparison of FIGS. 1, 2*a* and 2*b* show that said end point (60) can be rotated from the position in FIGS. 1 and 2*a* to the position in FIG. 2*b*, with the result being that in the FIG. 1 orientation paint can be applied by the roller sock (32) to the wall (80), and in the FIG. 2*b* orientation paint can be filled onto the roller sock (32). Note that FIGS. 1, 2*a* and 2*b* show that the end point (60) of said means (40) for rotatably affixing a roller sock (32) to said handle (50), is conveniently located for operation by a user's thumb. It is emphasised that FIGS. 2*a* and 2*b* show the present invention apparatus in painting and filling positions respectively.

Figure 3:
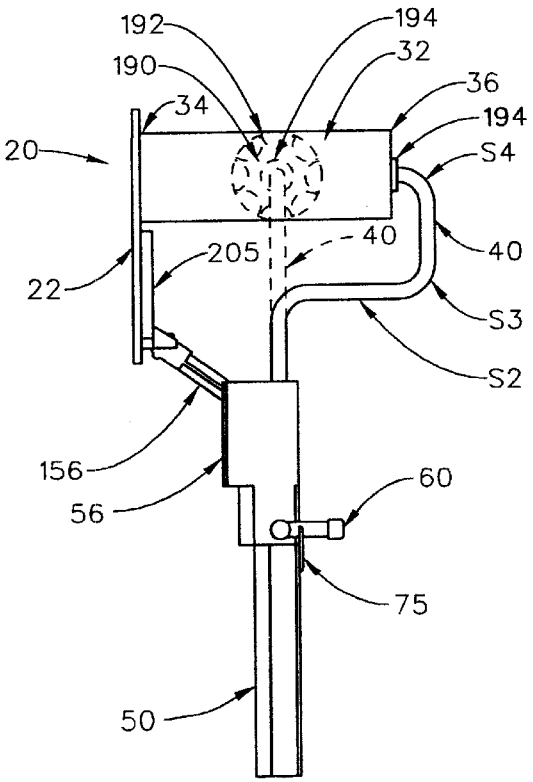
FIGS. 3 and 4 show front and side views of a present invention apparatus with the roller sock oriented in both filling and painting positions.

It should be noted that means (40) for rotatably affixing a roller sock (32) to said handle (56) is a shaft, a first portion of which has an axis oriented essentially parallel to said longitudinal axis of said handle and is positioned within said handle (56). FIGS. 3 shows that said shaft further comprises a second (S2) portion oriented perpendicularly to said first portion, and another, third (S3), portion again oriented essentially parallel to said longitudinal axis of said handle and another, fourth (S4), portion which is again oriented perpendicular thereto, to which fourth (S4) recited shaft portion the roller sock is affixed via roller sock support means via interface (190).

Continuing, FIGS. 1 and 2*a* and 2*b* also show a locking means (75). In FIG. 1 said locking means (75) is shown pushed forward, (toward the roller sock), to secure the bend (64) of the means (40) for rotatably affixing a roller sock (32) to said handle (56), and maintain the roller sock (32) in a painting position. Locking means (75) provides utility in that in use a FIG. 1 orientated roller sock (32) can not inadvertently rotate toward a FIG. 2*b* orientation. Note in FIG. 2*b* that said locking means (75) is slid back out of a locking position. The presence of a locking means (75) is considered an important aspect of the present invention as it overcomes a problem encountered in use of the system described in U. S. Pat. No. 5,623,740, which 740 Patent was previously granted to the Inventors of the present invention.

FIG. 1 also shows that an edge guard (20) having a plurality of edges, (eg. exemplary and not exclusively shown as rectangular, (21) (22), (23) and (24)), and front (26) and back faces, which edge guard (20) is affixed to said handle (56) via elements (156) and (25) for affixing said edge guard to said handle such that the plane of the front face (26) thereof faces and extends essentially parallel to the longitudinal axis of the handle, but is offset therefrom. Note also that while FIG. 1 demonstrates one edge (21) of the edge guard (20) is in contact with the wall (80), an edge oriented 90 degrees thereto, (eg. edge (22) or (24)), can alternatively be placed against the wall (80) in use when such is more convenient. In fact element (156) which interconnects handle (56) and element (25) is actually more compliant and better able to allow edge guard (20) to move with respect to the where roller sock (32) and contact wall (80) when edge (22) is positioned to contact wall (80).

Figure 6:
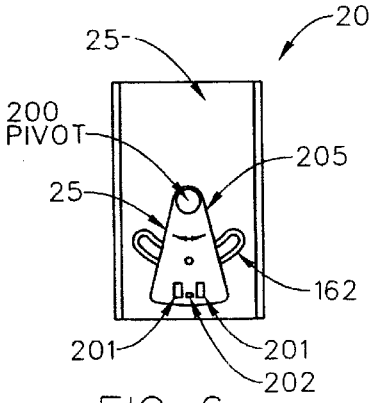
FIGS. 6 and 7 show front and back views of a present invention an edge guard means.
Figure 7:
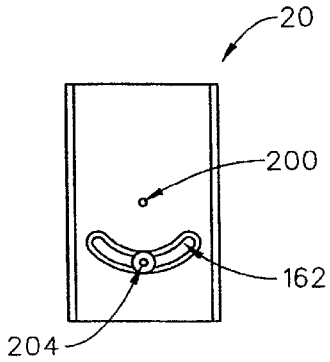

FIGS. 6 and 7 show front and back views of edge guard (20). FIG. 6 shows that the means (25) for affixing said edge guard to said handle can comprise an essentially triangular, (any functional shape is to be considered equivalent), shaped element which is pivotally mounted via pivot (200) to the edge guard (20), and FIG. 7 shows inclusion of a projection at (204) through a slit (162), said slit being shaped as an arc plotted out by said projection (204) based on rotation around pivot (200) interconnection between element (25) and said edge guard (20). Note that elements (201) on the front (205) of element (25) for affixing said edge guard to said handle forms a demonstrative bracket which receives element (156), (which interconnects the handle (56) and element (25)), although any functional attachment means is within the scope of the present invention. Note that a preferred construction provides that element (202) fits into a hole in element (156), (ie. male-female coupling), and brackets (201) provide stability, (ie. prevent movement between element (202) at its projection point into element (156) which can occur at the interconnection point therebetween when the brackets (201) are not present). FIG. 7 shows a back view of the the means (25) for affixing said edge guard to said handle, showing the rear portion of pivot (200) and projection (204). Note indication of a recessed region around slit (162) into which the head of projection (204) fits such that it is flush with the back face of the edge guard (20). Said edge guard (20) is shown as rectangular with four edges, but it is to be understood that it could have a single flat edge, and circular, and/or other shaped additional edges etc. Any functional shape is within the scope of the present invention.

Figure 4:
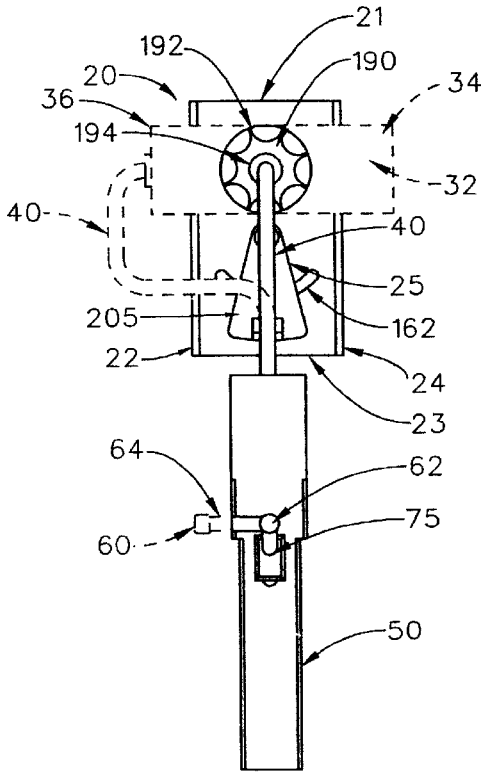

FIGS. 3 and 4 present invention in front and side views and each shows the roller sock (32) in:

- a painting position, wherein said longitudinal axis of said roller sock (32) is oriented essentially perpendicular to and adjacent to said edge guard front face; and
- a filling position wherein the roller sock (32) longitudinal axis is oriented other than essentially perpendicular to said edge guard front face, and typically parallel thereto.

FIG. 3 shows the locking means (75) in position to maintain the roller sock (32) in the "painting"orientation. FIG. 4 shows the locking means (75) in position to allow switching between painting and filling positions. Note that dashed and solid leader lines serve to identify the same elements in each Figure, respectively in different orientations and positions. FIGS. 3 and 4 also identify ends (34) and (36) of the roller upon which is the roller sock (32), as well as means roller support means (190) which comprises a plurality of teeth or wires or functional equivalents (192) and which slid into a roller sock covered roller. Note that (194) indicates a tubular central portion of said roller support means (190), to which an extended portion of said means (40) for rotatably affixing a roller sock (32) to said handle (50), via forward portion (56) thereof, is attached.

Figure 8A:
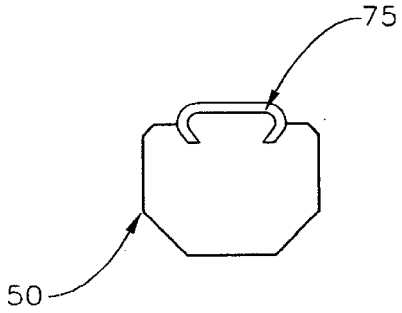
FIGS. 8*a* and 8*b* show two possible demonstrative approaches to attaching locking means, for securing a roller sock in a painting position, to the present invention handle.
Figure 8B:
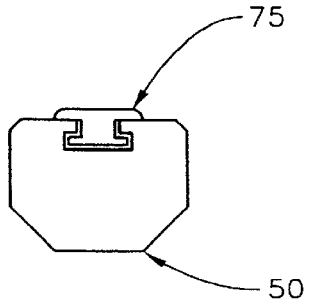

FIGS. 8*a* and 8*b* show two possible demonstrative approaches to attaching the locking means (75) to handle (50). However, any functional approach to said interconnection is within the scope of the present invention.

It is specifically stated that the present invention is not limited to any overall dimensions, and that any roller sock can be utilized. For instance, the roller sock can be homogeneous or can have a patterened surface, and of a length of from less than four inches long to a length consistant with conventional wall painting roller socks. As well the diameter of a roller sock can be of any functional dimension. The Drawings are not to be interpreted to limit the present invention system dimensions, (relatively or absolutely), by the demonstrative, rather than limiting example shown which includes presentation of a human hand. Specifically, the elements (S2) (40) and (S4) can be modified, (eg. shortened or lengthened), to accomodate use of any size roller sock. Further, the edge guard (20) can be of any functional dimensions, and shape and is not limited to the demonstrative rectangular shape shown. The claims are to be interpreted to include such variations.

Having hereby disclosed the subject matter of the present invention, it should be obvious that many modifications, substitutions, and variations of the present invention are possible in view of the teachings. It is therefore to be understood that the invention may be practiced other than as specifically described, and should be limited in its breadth and scope only by the claims.

We claim:

1. A paint roller apparatus used with a generally cylindrical roller sock in painting a surface which is adjacent to a surface which is not to be simultaneously painted, comprising:

a handle having a longitudinal axis;

an edge guard having a plurality of edges and front and back faces;

means for affixing said edge guard to said handle such that the plane of the front face thereof faces and extends essentially parallel to the longitudinal axis of the handle, but is offset therefrom;

means for rotatably affixing a roller sock to said handle such that a longitudinal axis thereof is oriented essentially perpendicular to the longitudinal axis of said handle;

such that said longitudinal axis of said roller sock can be rotated about said longitudinal axis of said handle between:

a painting position, wherein said longitudinal axis of said roller sock is oriented essentially perpendicular and adjacent to said edge guard front face; and a filling position wherein the roller sock longitudinal axis is oriented other than essentially perpendicular to said edge guard front face, and typically parallel thereto;

such that upon causing said roller sock to contain paint, and the placing of said roller sock in said painting position, and the positioning said back face of said edge guard adjacent to a surface which is not to be painted, said roller sock can be moved into contact with a surface to be painted by application of pressure to said handle, thereby causing the roller sock to contact said surface to be painted and apply paint on said roller sock thereto, while said edge guard substantially blocks application of paint to said adjacent surface;

said paint roller apparatus further comprising a locking means on said handle which allows fixing said roller sock in a painting position wherein the roller sock longitudinal axis is oriented essentially perpendicular to, and adjacent to said edge guard front face, said locking means being slidably mounted on said handle in a manner allowing movement thereof along the direction of the longitudinal axis of said handle, said locking means being positioned so as to allow engagement and disengagement of said extension of said shaft which is perpendicularly oriented to said longitudinal shaft axis.

2. A paint roller apparatus as in claim 1 in which the means for affixing said edge guard to said handle comprises male-female coupling.

3. A paint roller apparatus used with a generally cylindrical roller sock in painting a surface which is adjacent to a surface which is not to be simultaneously painted, comprising:

a handle having a longitudinal axis;

an edge guard having a plurality of edges and front and back faces;

means for affixing said edge guard to said handle such that the plane of the front face thereof faces and extends essentially parallel to the longitudinal axis of the handle, but is offset threfrom;

means for rotatably affixing a roller sock to said handle such that a longitudinal axis thereof is oriented essentially perpendicular to the longitudinal axis of said handle;

such that said longitudinal axis of said roller sock can be rotated about said longitudinal axis of said handle between:

a painting position, wherein said longitudinal axis of said roller sock is oriented essentially perpendicular to and adjacent to said edge guard front face; and a filling position wherein the roller sock longitudinal axis is oriented other than essentially perpendicular to said edge guard front face, and typically parallel thereto;

such that upon causing said roller sock to contain paint, and the placing of said roller sock in said painting position, and the positioning said back face of said edge guard adjacent to a surface which is not to be painted, said roller sock can be moved into contact with a surface to be painted by application of pressure to said handle, thereby causing the roller sock to contact said surface to be painted and apply paint on said roller sock thereto, while said edge guard substantially blocks application of paint to said adjacent surface;

said means for rotatably affixing said roller sock to said handle such that the longitudinal axis of said roller sock can be rotated about said longitudinal axis of said handle between a painting position and a filling position, comprises a shaft with an axis oriented essentially parallel to said longitudinal axis of said handle, said shaft with an axis oriented essentially parallel to said longitudinal axis of said handle being rotatably mounted in said handle, and said shaft with an axis oriented essentially parallel to said longitudinal axis of said handle further having an extension thereof oriented essentially perpendicular to said longitudinal axis of said handle and extending out of said handle in a user accessible manner, such that user application of pressure to said extension can cause rotation of said shaft with an axis oriented essentially parallel to said longitudinal axis of said handle, about said shaft longitudinal axis;

said paint roller apparatus further comprising a locking means on said handle which allows fixing said roller sock in a painting position wherein the roller sock longitudinal axis is oriented essentially perpendicular to, and adjacent to said edge guard front face, said locking means being slidably mounted on said handle in a manner allowing movement thereof along the direction of the longitudinal axis of said handle, said locking means being positioned so as to allow engagement and disengagement of said extension of said shaft which is perpendicularly oriented to said longitudinal shaft axis.

4. A paint roller apparatus as in claim 3, wherein the means for affixing said edge guard to said handle is non-rigid, such that application of pressure to said handle to place said roller sock in contact with a surface to be painted allows an edge of said edge guard, which in use contacts said surface to be painted, to move backward and become positioned even with, or behind said roller sock at said location of said roller sock contact to said surface to be painted.

5. A paint roller apparatus as in claim 4, wherein at least the edge of said edge guard which in use contacts said surface to be painted, comprises a bevel shape.

6. A paint roller apparatus as in claim 3 wherein said locking means on said handle, which allows fixing said roller sock in a painting position, is positioned so as to be easily operated by a user's thumb when said user holds the paint roller apparatus by said handle.

7. A paint roller apparatus as in claim 3, wherein said locking means on said handle is positioned so as to be easily operated by a user's thumb when said user holds the paint roller apparatus by said handle.

8. A paint roller apparatus as in claim 3 in which the means for affixing said edge guard to said handle comprises male-female coupling.

* * * * *